United States Patent [19]

Takahashi

[11] 4,294,436

[45] Oct. 13, 1981

[54] FURNACE WITH PROTECTIVE ATMOSPHERE FOR HEATING METALS

[75] Inventor: Susumu Takahashi, Yokohama, Japan

[73] Assignee: Kanto Yakin Kogyo Kabushiki Kaisha, Japan

[21] Appl. No.: 182,774

[22] Filed: Aug. 29, 1980

[30] Foreign Application Priority Data

Sep. 5, 1979 [JP] Japan ..... 54-112996

[51] Int. Cl.[3] ..... C21D 1/06

[52] U.S. Cl. ..... 266/257; 266/252

[58] Field of Search ..... 266/251, 252, 257

[56] References Cited

U.S. PATENT DOCUMENTS 2,543,708 2/1951 Rice et al. ..... 266/252

3,237,428 3/1966 Warman ..... 266/251

3,519,257 7/1970 Winter et al. ..... 266/251

*Primary Examiner*—L. Dewayne Rutledge

*Assistant Examiner*—John P. Sheehan

*Attorney, Agent, or Firm*—Shlesinger, Fitzsimmons & Shlesinger

[57] ABSTRACT

A furnace for the heat-treatment of metallic articles with a protective atmosphere such as a reductive gas mainly consisting of $H_2$, CO, $N_2$. Said protective atmospheric gas is made from LPG, LNG, urban gas and other raw natural gases which have been supplied into the furnace directly from their sources by heating them by heating elements within the furnace and simultaneously converting them by a plurality of catalytic means extending along said heating elements.

3 Claims, 2 Drawing Figures

FURNACE WITH PROTECTIVE ATMOSPHERE FOR HEATING METALS

BACKGROUND

When metals are treated in a furnace with a protective atmosphere of hydrocarbon gas, said gas is commonly converted from a raw gas material by an endothermic or exothermic gas generator which is provided independently from the furnace, and then supplied into the furnace.

In this invention, the raw gas material is supplied directly into the furnace without employing any such independent gas generator, wherein said raw gas material becomes within the furnace per se a converted gas which constitutes a protective atmosphere of said furnace, and whereby costs for producing the converted gas become extremely low since it does not employ any gas generator of the aforementioned kind, and costs for reheating the gas which has been converted in the gas generator and is being sent into the furnace are also saved.

Working principle of this invention is to provide a furnace with a plurality of curtains or walls which are made from a catalyst of metals or metal oxides and which extend within the furnace at locations outside of charging and discharging passages for articles to be treated in the furnace and adjacently to heating elements within the furnace so that they can effectively be heated. A raw gas material such as LPG, LNG, or urban gas which has been supplied into the furnace with air is changed, by its contact with the catalytic curtains or walls within the furnace, to heated and converted gas, under the protection of which metallic articles are heattreated.

Hence, this invention is to provide a furnace with protective atmosphere for heating metallic articles, in which a converted gas for producing said protective atmosphere is not formed by a gas generator which is independent to the furnace, but it is formed by supplying a mixture of LPG, natural gas, or urban gas with air directly into the furnace and by dissociating under heat said mixture gas by means of heating element and catalytic curtains or walls which are both provided within the furnace, to said protective atmosphere which is reductive for example for the effective heating or cementation of the metallic articles.

THE DRAWINGS

FIG. 1 is a sectional view of a heating zone of the continuous furnace made in accordance with this invention which consists of a preheating zone and a cooling zone connected to the ends of said heating zone, said view being taken in a direction transverse to the longitudinal direction of said furnace, and FIG. 2 is a cross sectional view of the batch type furnace made in accordance with this invention.

DETAILED DESCRIPTION

Figure 1:
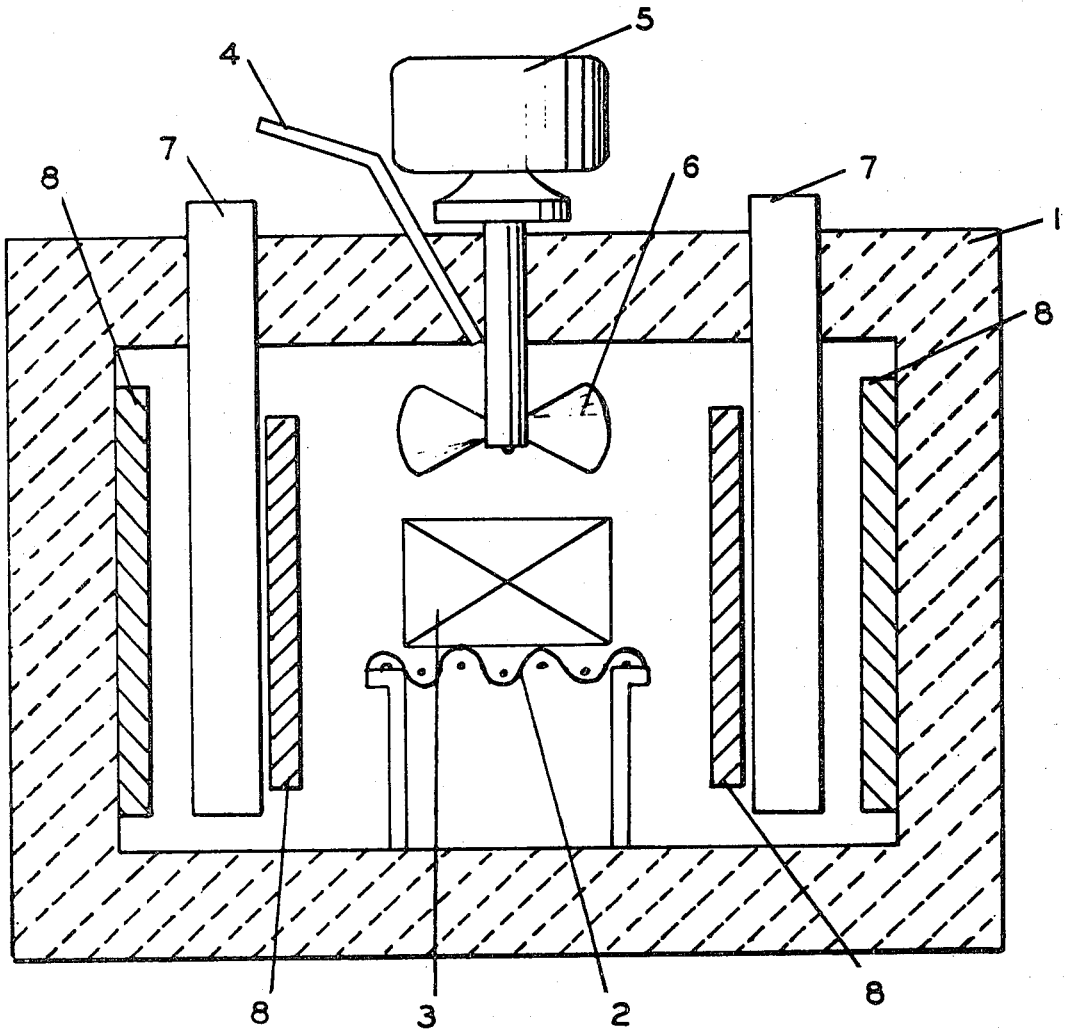

Referring to FIG. 1, the continuous furnace has an elongated refractory enclosure 1 which constitutes a preheating zone, heating zone, and cooling zone, through which a conveyor 2 moves for subsequently transferring metallic articles 3 to be treated through said preheating zone, heating zone, and cooling zone. The heating zone is provided at its upper part with one or a plurality of pipes 4 for supplying raw gas material into the furnace. Adjacent to the opening ends of said pipes

4, there are provided fan agitators 6 which are driven by motors 5. Numerals 7 indicate heating elements extending vertically within the heating zone, adjacent to its lateral side walls, and with desired spaces therebetween. Numerals 8 indicate a plurality of curtains or walls made from a metallic catalyst which extend substantially over the all height of the heating zone and adjacently to or along the heating elements 7 so that they do not intervene in the moving passage of the metallic articles 3 mounted on the conveyor 2. With the above constructions, the raw gas material supplied into the heating zone by the pipes 4 is agitated by the fans 6 and comes to make contact with the heating elements 7 and the catalytic walls and curtains 8, whereby the gas is heated and converted to a reductive atmospheric gas. This gas is discharged continuously and gradually outside the furnace via the preheating zone or cooling zone.

EXAMPLE 1.

Low carbon steel articles were passed through the furnace having the constructions which are explained in the above with reference to FIG. 1. The catalytic curtains and walls 7 are made from nickel, and the heating zone was kept at 930° C. The raw gas material supplied to the heating zone was a mixture of 15 volume % of methane gas and the balance % of air, at a rate of $32m^3$/minute. The said articles were annealed successfully without oxidation thereof and without losing their brightness. This confirms that the atmosphere within the furnace was kept reductive.

EXAMPLE 2.

The furnace same to Example 1 was employed under the same conditions to Example 1 but the temperature in the heating zone being kept at 850° C. Articles assembled from steel plates with portions to be soldered by JIS 3264-BCuP1 were passed though the furnace. They were successfully soldered without losing their brightness.

Figure 2:
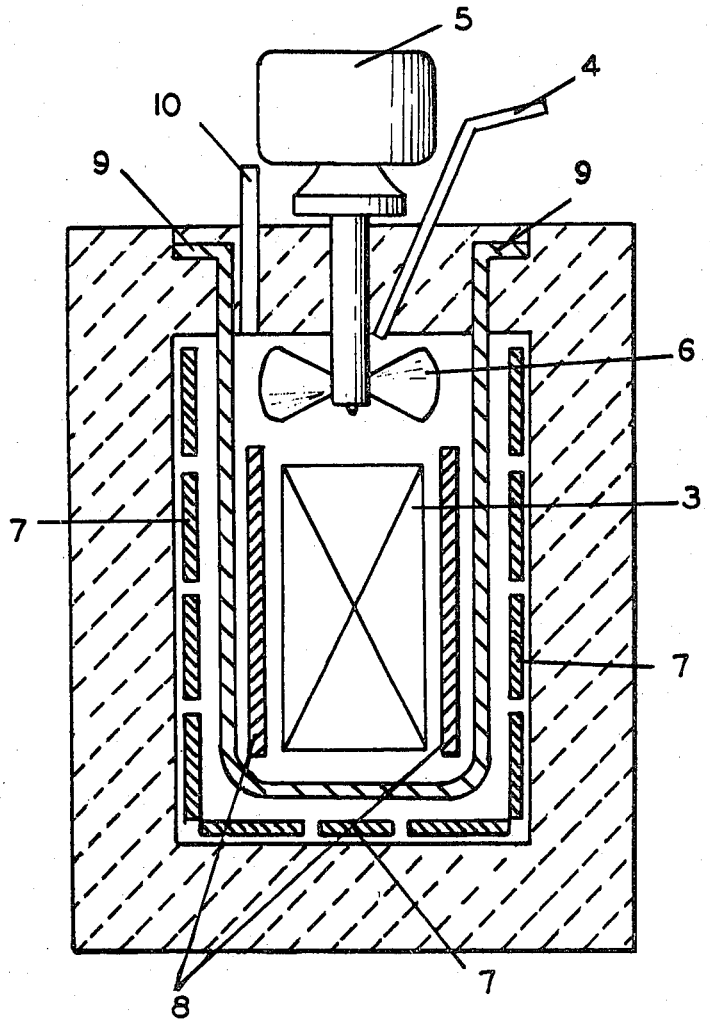

The batch type furnace illustrated in FIG. 2 has constructions same to FIG. 1 in principle. In said FIG. 2, those parts which are correspondent to those in FIG. 1, are indicated by numerals identical to FIG. 1. Numeral 9 indicates a pot, and numeral 10 openings for discharging a gas from the furnace.

EXAMPLE 3.

Into the furnace illustrated in FIG. 2, an article made from low carbon steel was placed. The catalytic curtains 8 were made from nickel. The furnace was supplied by $1.8m^3$ of a mixture of 40 volume % of methane gas and the balance of air. The furnace with the said article therein was heated to 930° C. for one hour. The article came to have a carburized layer of 0.3 mm in thickness and containing 0.8% carbon at its surface.

What is claimed is:

1. A furnace having a protective atmosphere therein for heat-treating metallic articles, comprising a heating enclosure having between the sidewalls thereof a space for accommodating said articles to be treated within the furnace, piping means having its discharge communicating with said space for supplying into said enclosure a raw material gas for forming said protective atmosphere, heating elements provided in the said enclosure, and catalytic means extending into the enclosure adjacent to said heating means and and operative to react with said raw material gas to convert it into said protective atmosphere, said catalytic means comprising a plurality of spaced, metallic, catalytic elements secured in said enclosure adjacent opposite sides thereof, and with at least certain of said catalyst elements being disposed in spaced relation to said sidewalls of said enclosure.

2. A furnace as defined in claim 1, including an agitator mounted in said enclosure and operative positively to circulate the gas therein.

3. A furnace as defined in claim 1, wherein said catalytic elements are positioned adjacent opposite sides respectively, of said heating elements, and in spaced relation thereto.

* * * * *